US009051743B1

(12) United States Patent
Jalbert et al.

(10) Patent No.: US 9,051,743 B1
(45) **Date of Patent: *Jun. 9, 2015**

(54) APPARATUS AND METHODS FOR BUILDING OR DRYWALL TOOLS

(75) Inventors: David B. Jalbert, Coventry, RI (US); John V. Costa, Somerset, MA (US)

(73) Assignee: Exceptional IP Holdings, LLC

( * ) Notice: Subject to any disclaimer, the term of this patent is extended or adjusted under 35 U.S.C. 154(b) by 143 days.

This patent is subject to a terminal disclaimer.

(21) Appl. No.: 13/595,982

(22) Filed: Aug. 27, 2012
(Under 37 CFR 1.47)

Related U.S. Application Data

(63) Continuation of application No. 12/553,968, filed on Sep. 3, 2009, now Pat. No. 8,251,685.

(60) Provisional application No. 61/094,053, filed on Sep. 3, 2008.

(51) Int. Cl.
*E04F 21/00* (2006.01)
*E04F 21/165* (2006.01)

(52) U.S. Cl.
CPC ..... *E04F 21/00* (2013.01); *E04F 21/1655* (2013.01)

(58) Field of Classification Search
CPC ..... E04F 21/16; E04F 21/161; E04F 21/1655; E04F 21/1652; E04F 21/165; E04F 21/00
USPC ..... 425/87; 401/137, 171; 222/386, 386.5
See application file for complete search history.

(56) References Cited

U.S. PATENT DOCUMENTS

| | | | | | |
|---|---|---|---|---|---|
| 796,246 | A | | 8/1905 | Printz | 425/87 |
| 1,583,533 | A | * | 5/1926 | Deming | 222/386 |
| 1,613,239 | A | * | 1/1927 | Miller | 425/87 |
| 2,824,443 | A | | 2/1958 | Ames | 425/87 |
| 2,889,699 | A | | 6/1959 | Ames | 425/87 |
| 3,602,405 | A | * | 8/1971 | Ames | 222/386 |
| 4,301,198 | A | | 11/1981 | Prior | 428/2 |
| 4,664,611 | A | | 5/1987 | Kumar | 425/87 |
| 4,907,955 | A | | 3/1990 | Snipes | 425/87 |
| 5,059,050 | A | * | 10/1991 | Guglielmo | 401/171 |
| 5,513,882 | A | * | 5/1996 | Lewis | 285/305 |
| 5,695,788 | A | | 12/1997 | Woods | 425/87 |
| 5,814,351 | A | * | 9/1998 | Mower | 425/87 |
| 5,882,691 | A | | 3/1999 | Conboy | 425/87 |
| 5,984,152 | A | * | 11/1999 | Jacobsen et al. | 222/495 |
| 6,427,877 | B1 | | 8/2002 | Trout | 222/386 |
| 6,450,723 | B1 | * | 9/2002 | Lithgow | 401/266 |
| 6,581,805 | B2 | | 6/2003 | Conboy et al. | 222/340 |
| 6,685,784 | B1 | | 2/2004 | Jacino et al. | 156/94 |
| 7,114,869 | B2 | | 10/2006 | MacMillan | 401/5 |

(Continued)

*Primary Examiner* — Yogendra Gupta
*Assistant Examiner* — Emmanuel S Luk
(74) *Attorney, Agent, or Firm* — Wolff Law Offices, PLLC; Kevin Wolff

(57) ABSTRACT

The present invention is directed generally to building tools that are high quality, durable, and in some case lightweight and may include an output port assembly coupled to a mastic applicator container or housing. The output port assembly may have multiple sections that may be made separately and uniquely so as reduce tool weight, corrosion, and cost without degrading strength and durability. The output port assembly may be made bi-material and of different portions made by different processes. The bi-material may include, for example, a metal cone and a plastic mounting coupling portion. The output port assembly may be coupled to a mastic applicator housing or container, and sealed thereto using a preformed seal or a preformed geometric seal.

20 Claims, 11 Drawing Sheets

(56) References Cited

U.S. PATENT DOCUMENTS

| | | | | |
|---|---|---|---|---|
| 2002/0046541 | A1 | 4/2002 | Grunst | 52/741.4 |
| 2002/0074361 | A1 | 6/2002 | Trout | 222/386 |
| 2005/0100386 | A1 | 5/2005 | Murray | 401/5 |
| 2005/0106278 | A1* | 5/2005 | Hall et al. | 425/87 |
| 2010/0260530 | A1* | 10/2010 | Schlecht et al. | 401/48 |
| 2010/0260879 | A1* | 10/2010 | Schlecht et al. | 425/87 |
| 2011/0091590 | A1* | 4/2011 | McMahon et al. | 425/87 |
| 2011/0164917 | A1* | 7/2011 | Yu | 401/266 |

* cited by examiner

APPARATUS AND METHODS FOR BUILDING OR DRYWALL TOOLS

This patent application claims priority to, and is a continuation of, U.S. patent application Ser. No. 12/553,968, filed on Sep. 3, 2009 now U.S. Pat. No. 8,251,685, which claims benefit of U.S. Provisional Patent Application No. 61/094,053, filed Sep. 3, 2008. These prior patent applications are hereby incorporated herein by reference for all purposes.

FIELD OF THE INVENTION

The present invention pertains to methods and various apparatuses for building tools. For example, the invention involves various methods and apparatuses for high quality application of, for example, cements, concretes, mastic and/or muds for use in building and/or construction.

BACKGROUND

Various tools have been known in the past for working with cements, concretes, mastics and/or muds to, for example, prepare, apply and finish a desired shape or smooth surface for various building surfaces. For example, some tools used for preparing the surface of, for example, concrete, include trowels. Another example are various tools used to prepare and finish, for example, mastics and mud for drywall, including corner finishing boxes, joint boxes, and automatic taper machines. Some examples of various previously known applicators and/or finisher tools may be found in U.S. Pat. Nos. 5,882,691; 6,581,895; and 7,114,869, among others. In any case, these types of tools and corner applicator boxes are typically hand tools that are used to apply and/or smooth various building surfaces such as floors and walls and result in skilled craftsman working on a number of surfaces for long periods of time during the work day. These types of tools are also exposed to bumps and mechanical stresses as well as corrosive substances in their use. Further, various tools may be susceptible to excessive wear due to their design and hard and extensive use in the field. Therefore, it is advantageous to build such tools to be cost effective, light in weight and durable against extensive use. It is also a primary advantage for these tools to apply a quality surface coating which requires a minimum of subsequent process to yield a finished surface. These characteristics are especially advantageous for tools used to finishing various corner regions, for example, inside corner applicator boxes and finishing tools used in drywall construction.

One particular example of corner applicator box 100 is illustrated in FIGS. 1-3 and is typically made in the form of a container or housing that has a plurality of side walls, e.g., side wall 105, a front wall 110, and a bottom wall 115. The top of the container or housing is typically provided by a movable pressure plate 120 which is used to drive out mud (enclosed in the container or housing) through an output port 125 (usually in a bottom wall 115 opposite the pressure plate) when force is applied to the movable pressure plate 120 by the user. A handle attachment bracket 130 is attached to the pressure plate 120 and includes a hole 135 for receiving one end of a handle (not shown). The handle may be used to lift the corner applicator box 100 and push the pressure plate 120 so as to apply mastic or mud to, for example, a drywall surface. A cone piece 140 may be attached to the corner applicator 100 housing. The cone may have a slightly offset center and be similar to, but not exactly, a conical shape so that a nipple 145 of the cone piece 140 is positioned slightly off from the center of the cone and forward toward the front wall 110 and the front of the applicator box 100. It is noteworthy that the angle of both the front wall 140A and the back wall 140B of the cone 140 between a flange end and the nipple 145 are comprised of a single straight continuous line and angle, although each of the front wall 140A and back wall 140B has a different angular pitch. The cone piece 140 has an output port 150 also, comprised of a hole in the nipple 145. Although not shown, the nipple 145 will be pivotably coupled to a corner finishing tool (not shown) having an angle that is in the shape of a triangle so as to fit into the inside 90 degree corner of, for example, a wall or ceiling joint where two walls or the wall and a ceiling of a room come together. The entire cone piece 140 is produced as a single piece made of a single material, e.g., cast from either zinc, aluminum, or stainless Steel. The cast zinc and aluminum versions require a coating to protect the part from the corrosive environment experience with working materials such as mastic or mud, as well as to protect from excessive wear in the connecting ball area 145, which can be exacerbated by the working materials. When the pressure plate 120 is moved toward the bottom wall 115 (pivoting around pivot point 155), mastic or mud placed in the housing will be forced out through output port 125 of the housing, through the cone 140, out the output port or hole 150 of the cone 140, and distributed in a corner joint area of a wall via the finishing tool (not shown). The corner applicator box 100 is typically used for finishing corners of drywall construction for building walls of rooms inside a building (e.g., office or house).

Referring to FIG. 3, the cone 140 construction and means for connecting the cone 140 to the housing are better illustrated. As can be seen from FIG. 3, the widest portion of the cone 140 includes flange 310 with three sides walls 314, 315, and 316. The front side wall 315 of the flange 310 includes two attachment holes through which two bolts or screws are place through this cone 140 front wall 315, and the housing front wall 110, and nuts 325 (or screws) are attached to hold the screws or bolts (or nuts), housing and cone together. As such, either the head of a bolt or screw (or nut) will be extending or protruding from the inner surface of the housing front wall 110 into the interior of the housing. An inner surface 318 of the flange 310 is mounted to the outer surface of the housings bottom surface 115 using three screws 320A, 320B, and 320C. The inner surface 318 of the flange 310 is made so as to be generally flat and smooth. To ensure a leak proof fit between the cone 140 flange 310 and the housing bottom wall 115 and front wall 110, a liquid sealant or glue, for example silicone, is applied to the flange 310 and/or housing wall 115 (and possibly front wall 110) where they interface. Traditionally this joint is sealed using a hand applied sealant which spreads out across the surfaces between the parts at assembly creating the needed seal. This method although functional results in the parts being 'adhered' together due to the properties of the sealants used for this task. This bonded joint reduces the efficiency of production and maintaining these tools due to the time involved to place the sealant, remove the excess, and remove it during maintenance should the cone need to be removed for replacement or cleaning.

SUMMARY

The present invention is directed generally to building material applying tools that may be high quality, durable, lower in cost, and in some cases lightweight, and various methods for making the tools. For example, the building material applying tools may include tools for applying materials such as cements, concretes, mastics and/or muds. The various tools may have a housing or container that may be made from multiple sections or a single integrated piece, and may be made of either metal or plastic material. These tools may have a movable pressure plate placed in a first opening of the housing or container so as to provide a mechanism for pushing, for example, mud or mastic in the housing or container out an output hole of the container or housing so as to apply the mastic or mud in a controlled manner to, for example, an attached tool which applies the material to the building surface. Further the mud being pushed out of the housing may be transferred through a cone shaped feature, which may be at least partially a conical shape, to cause the material to flow out of a small opening. In various embodiments the cone may be designed so as to transfer the mud or mastic to the building surface without unduly raising the pressure required to move the mud out of the housing. The tool may include a nipple or ball shaped connection that the mud then flows through and that connects into a tool specifically design to distribute mud on the wall surface, for example, a corner finishing tool. The cone, which may be at least partially a conical shaped structure, may be instrumental in providing a channel from the mud storage tool housing or container to the mud applying tool, e.g., a corner finisher tool.

In addition, the cone or at least partially conical shaped structure must be strong enough to resist the forces generated during use and unexpected dropping or banging of the tool while on the job site. Further, the conical structure must resist the corrosive environment of the mud both in use and during storage which is often in a watery muddy mix. Finally the ball end structure of the cone must withstand the pressure and where associated with the constant motion, e.g., pivoting motion, of the finishing tool which is mounted at that location. The two tool portions are in constant motion relative to each other and coated with abrasive mud during use.

In various embodiments of the invention the cone shaped or at least partially conical shaped, structure may be produced from two parts rather than one single part. The ball end or connection structure of the cone or at least partially conical shaped structure may be produced from, for example, a metal such as stainless steel, for its strength, wear and corrosion resistance. The ball end or connection structure may be combined with or molded with a cone or conical shaped wall structure using a material which may be light weight, low cost, strong and corrosion resistant, for example a plastic material. For example, the ball end or connection structure may be insert molded with a plastic type material so as to form a bi-material structure. The plastic material may be a rigid petroleum based or synthetic based material that has the desired structural and formability characteristics. The plastic material may include fiber. The output port of the cone may be offset from center, for example, may be shifted more closely to the front wall of the container or housing. The side walls of the resulting bi-material cone shaped or at least partially conical shaped structure may have a single angle pitch from a flange end to the ball end, or may include a plurality of angles on one or more sides as desired. The plurality of angles may improve manufacturability of the at least two piece structure, may improve the pivoting aspects of a corner finisher tool on the cone, and may help place the cone and ultimately the corner finisher tool attached thereto, closer to the front wall of the container or housing upon which the cone may be mounted. Further, the walls may be made thicker in the plastic portion than the metal portion, if desired, to provide better adhesion to one another and better strength. The resulting bi-material cone shaped or at least partially conical shaped structure including a nipple, formed of two different materials, may then be mounted to existing tools the same way traditional cones have been mounted or in alternative ways that may be more cost effective to manufacture and assemble. However, the new part may now be designed to meet the varying needs of each region of the part by utilizing the best material for that area. The lighter weight material section structure, for example plastic, may be molded over and/or through portions of the ball end section to ensure that the overall cone shaped or at least partially conical shaped structure including the ball end never separates under the stresses found on the job site for tools of this nature. In various embodiments, the stainless steel and plastic materials may be made of various different combinations of materials, for example, Stainless steel with aluminum, plastic with aluminum, plastic with zinc, etc., as long as the materials for each section meet the desired characteristics and may be manufactured.

In various embodiments, the grade of material such as plastic, and/or presence of a filler in the material can vary to best suit the manufacturing needs or specific conditions of the tools. Further it is understood that the specific location and mechanical coupling methodology used for mating and attachment between the two different types of materials may also vary without detracting from the purpose of this invention.

In various embodiments, one or more preformed seal(s) can be used between the tool housing or container and the flange of the cone shaped or at least partially conical shaped output structure, so as to ensure there is no leakage at this joint. The flange may be formed to include a channel into which the preformed seal(s) may be placed and retained after assembly. This may be achieved easily using a molding process for plastics or stamped of cast in for metal materials. In various embodiments, the preformed seal(s) may be formed in a keyhole shape or a circular shape (e.g, typical O-ring).

In various embodiments, all mounting holes may be formed in the bottom flange of the cone shaped or at least partially conical shaped output structure so as to improve the cost of manufacturing the cone shaped or at least partially conical shaped output structure and lowering the assembly time and cost for mounting the cone shaped or at least partially conical shaped output structure to a container or housing. Further, the location of the mounting holes and related mounting screws and nuts may eliminate a seal around a movable pressure plate from encountering any nuts, screws, or other mounting mechanisms on the inner front wall of the container or housing.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION

The present invention is directed generally to building tools that may be made to be high quality, durable, less expensive to manufacture and assemble, or/and lightweight. As such, the present invention includes various embodiments showing methods and various apparatuses for working with mastic or mud and/or finishing drywall. One embodiment is directed to a corner applicator box which may typically be used for applying mastic or mud to complete drywall. This tool is typically used in conjunction with a corner finishing tool.

Figure 1:
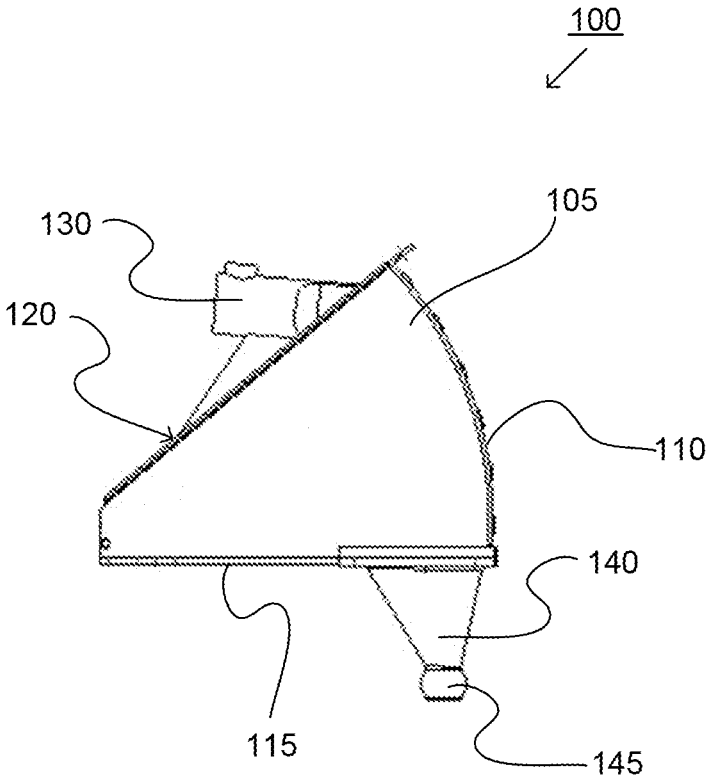
FIG. 1 is side view of prior art for a Corner Applicator box construction including a one end portion.
Figure 2:
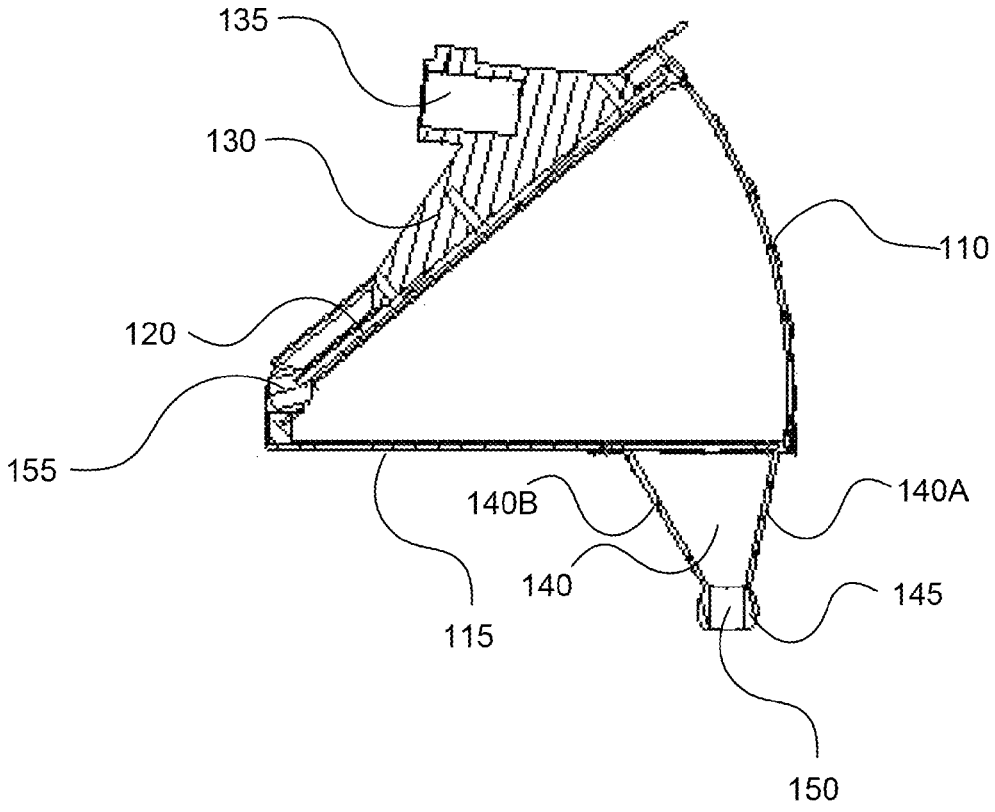
FIG. 2 is a side section view of the prior art for a Corner Applicator box construction showing a cross section view of the cone to housing construction.
Figure 3:
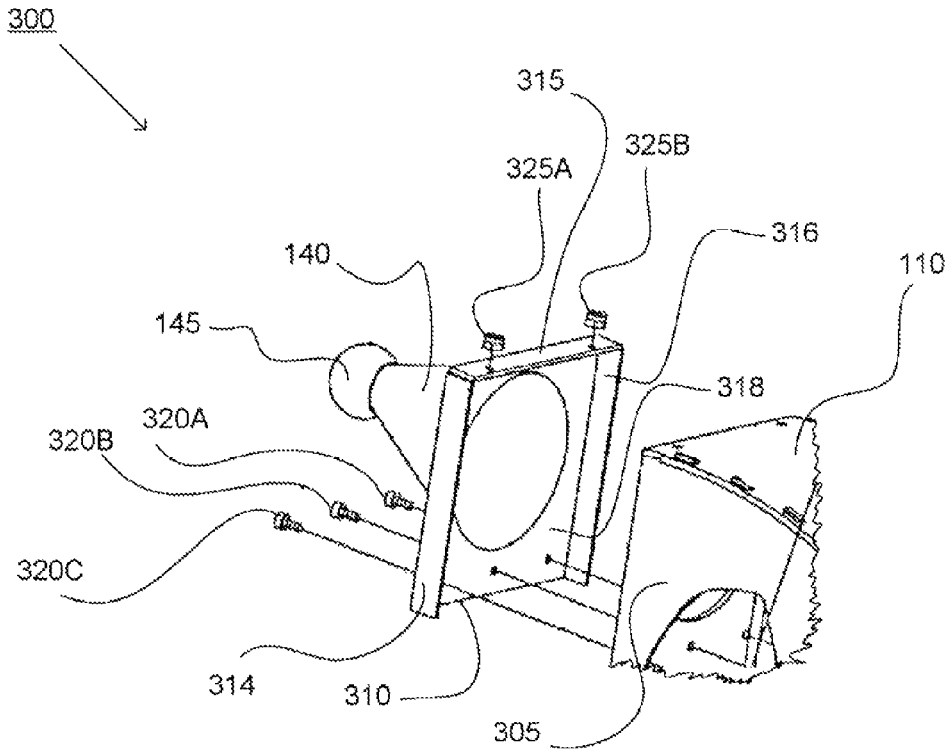
FIG. 3 is an exploded assembly view of prior art for a portion of the Corner Applicator box and cone to housing construction.
Figure 4:
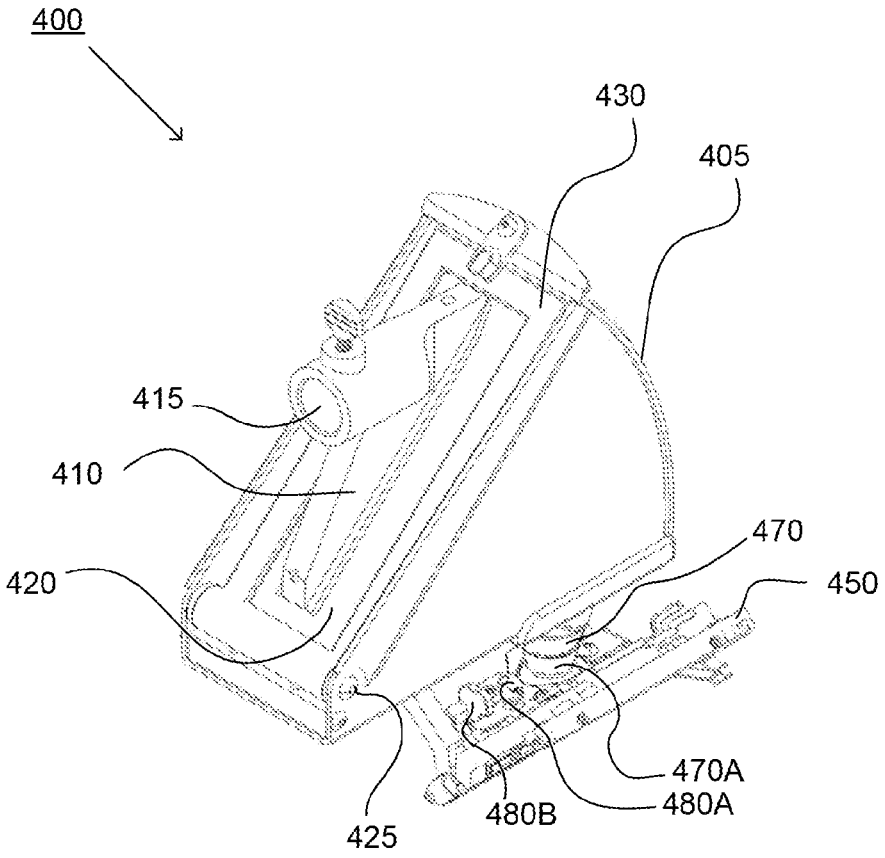
FIG. 4 is an isometric view of for a Corner Applicator box attached to a corner finishing tool, according to an exemplary embodiment of the invention.

Referring to FIG. 4, a corner applicator (405) is shown with the mating corner finisher 450 attached as a combined assembly 400. In particular, the corner applicator 405 is made in the form of a container or housing. The top of the container or housing 405 is provided by a movable pressure plate 420 which is used to drive out the mud when force is applied by the user. The pressure plate 420 may be pivotably attached via, for example, a pin 425, to the side walls of the container or housing 405 and have a handle attachment mount 410 connected to it. The handle attachment mount 410 may have a hole for receiving a handle (not shown) that may be pushed to lift the entire assembly 410 and apply pressure to the pressure plate 420 when desired, so as to push mud out of the container or housing 405. The pressure plate 420 may have a seal 430 placed around at least three of its four outside edges so as to form a seal with the front and side walls of the container or housing 405. The output port assembly 470, which may be at least partially conical shaped and have an offset cone portion, may be mounted to the applicator 405 on one end and may connect to the finisher tool 450 on another end. This output port assembly 470 may be the primary focus of this patent application, and will be described in more detail below. As can be generally seen the corner finisher tool 450 attaches at the ball end portion 470A of the output port assembly 470, and may be locked onto the ball end portion 470A through the use of a releasable locking feature 480 having a locking arm 480A and a releasing mechanism 480B, which are mounted to the corner finisher tool 450. Although shown herein as a new design releasable locking mechanism (the subject of a related patent application filed on Mar. 3, 2009 having provisional patent application Ser. No. 61/157,156, which is hereby incorporated herein by reference for all purposes), the locking and releasing feature may alternatively be one of several other types, for example, the locking mechanisms found in U.S. Pat. Nos. 5,622,729 and 7,114,869.

Figure 5A:
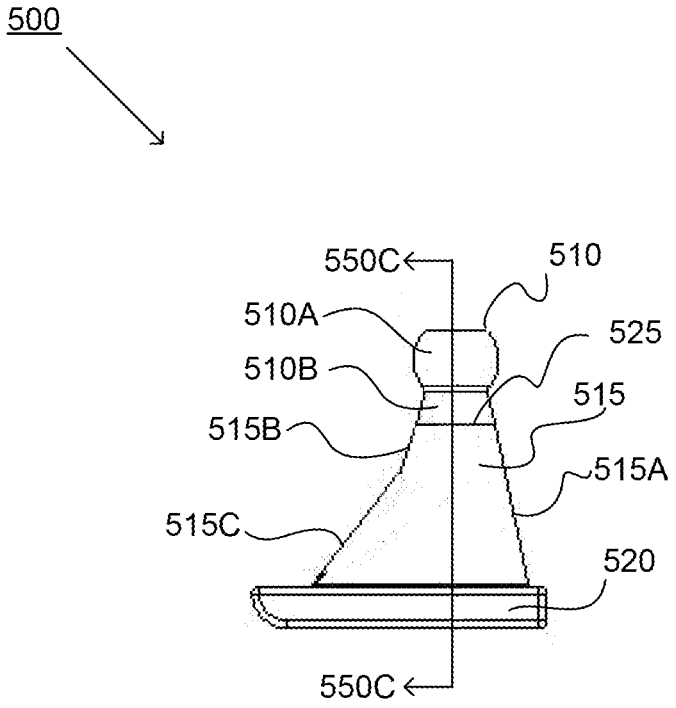
FIGS. 5A, 5B and 5C are side, partial section, and section views showing the construction of the over-molded bi-material cone, according to an exemplary embodiment of the invention.
Figure 5B:
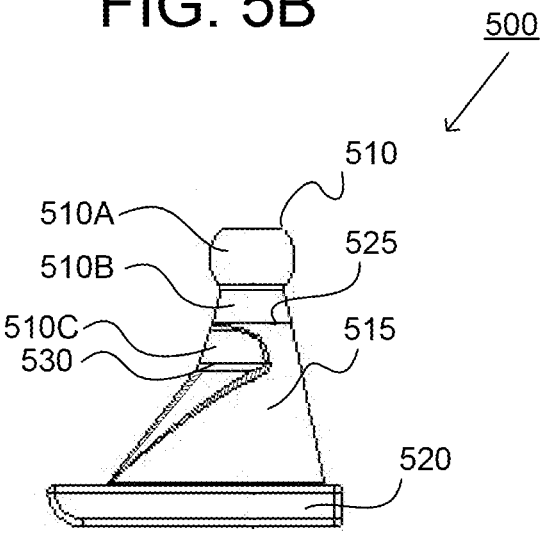
Figure 5C:
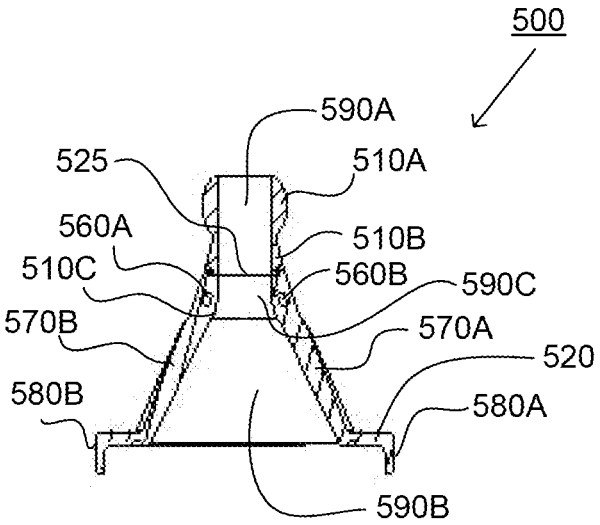

Referring now to FIGS. 5A-5C a more detailed description of the output port assembly part 500 will now be described. FIG. 5A shows a side view of the output port assembly 500. The output port assembly 500 may be formed from multiple portions with distinct areas. For example, in various embodiments, the output port assembly may be made of two pieces, a cone, conically shaped end 510 that interfaces with a corner finisher tool, and a container or housing mounting coupling portion 515 that may be connected to the cone or conically shaped end 510 and may be mounted to a corner applicator container or housing by a mounting base or portion 520, using for example, mounting screws or bolts (as shown in more detail below). In various other embodiments, the cone or conically shaped end 510, the container or housing mounting coupling portion 515, and the mounting base 520, may be made as three separate pieces. In any case, it can be seen that the output port assembly 500 may include mating line(s) 525 indicative of where the cone or conically shaped end 510 may be joined to the container or housing mounting coupling portion 515. The cone or conically shaped end 510 may have a ball or nipple shaped portion 510A and an angled wall portion 510B. The container or housing mounting coupling portion 515 may have a frontward facing (relative to the location corner applicator container or housing front wall) most wall 515A having a set slope or angle, and a rearward facing wall having a first slope or angle portion 515B and a second slope or angle portion 515C. The first slope or angle portion 515B and a second slope or angle portion 515C may have different slopes so as to merge the true cone or conically shaped end 510 to the conical offset shape of the container or housing mounting coupling portion 515, and to set the true cone or conically shaped end 510 forward toward the frontmost wall or edge of the corner applicator container or housing so that the corner finishing tool meets a corner of a wall and/or ceiling interface without dragging or interference from the corner applicator container or housing during mud application. In various embodiments, the various portions of the output port assembly 500 may be made of different materials. For example, the cone or conically shaped end 510 may be produced from a metal material or combination of metal materials, for example, an alloy of metals, a Stainless steel, etc., that may provide better wear resistance, corrosion resistance, and higher strength to withstand the stresses it experiences from the corner finishing tool and mud or mastic materials it is exposed to during use. The container or housing mounting coupling portion 515 and the mounting base or portion 520 may be produced from a rigid, durable, lighter weight and/or lower cost material such as a plastic, a filled plastic such as nylon with glass fiber filler for its strength, corrosion resistance, ability to be formed in complex shapes, and low cost, a petroleum based material, etc. Of course, as noted above, the mounting base 520 may be preferably made of a different material, from the cone or conically shaped end 510 and the container or housing mounting coupling portion 515. Although, as illustrated in FIG. 5, the mounting base 520 and the cone or conically shaped end 510 may be made of the same material and may be formed together as an integral single piece of material by, for example, a molding or casting process. The ball end 510 material can be Stainless steel, Zinc, Carbon steel, Aluminum, etc.; as noted above, possibly including various forms of protective coatings. The "cone" 515 can be any of a number of different types of plastic, for example, ABS, Nylon, Acetal, Urethane, etc. or even aluminum, magnesium or other light metal; although the metal may be less desirable. In various embodiments, the cone or conical shaped end 510 may be over-molded with a combined plastic container or housing mounting coupling portion 515 and mounting base or portion 520.

Referring now to FIG. 5B, a partial sectional view of the output port assembly 500 is provided. As indicated, a portion of the cone or conically shaped end 510, the portion 510C opposite the ball shaped portion 510A, may be overlapped and surrounded by a portion (angled wall portion 515C) of the container or housing mounting coupling portion 515. The interface line 525 shows the end of the overlap of the container or housing mounting coupling portion 515 over the cone or conically shaped end 510. As shown, the distance from the ball shape portion 510A to the interface line 525, is approximately the same distance from interface line 525 to the opposite end 530 of the cone or conically shaped end 510. Although, the distance of overlap is set to ensure that the cone or conically shaped end 510 remains attached to the container or housing mounting coupling portion 515 under all stresses that the output port assembly 500 will experience during normal use for applying mud or mastic, and any anticipate stresses that would be expected when transporting or dropping the tool. The distance between the interface line 525 and the ball or nipple shaped portion 510A may be set to ensure the interface is not overlapped by the corner finishing tool and the coupling means or releasable locking mechanism used thereon.

Referring now to FIG. 5C, a full sectional view of the output port assembly 500 is provided as taken along line 530C-530C looking backward in FIG. 5A. In this figure, one can see that there are two through holes 560A and 560B formed in the walls of section 510C of the cone or conically shaped end 510. These holes may help ensure flow of material during manufacturing and interconnection between the cone or conically shaped end 510 and the container or housing mounting coupling portion 515. Further, the flat lateral portion of the base 520 and vertical side portion 580A and 580B are formed to interface with the bottom, front and side walls of the applicator housing or container, respectively, so as to form a sealed unit that will not leak when pressure is applied to the movable pressure plate while the mud or mastic is pushed through the output port assembly 500 into a corner finishing tool. This may be achieved by porting funnel and holes or channels formed in the output port assembly 500. As shown in this figure, the output port assembly 500 may include porting sections 590A, 590B and 590C. Section 590B may couple to the inside of the applicator housing or container and is formed in the shape of a funnel so as to accumulate the compressed material into a smaller output hole, 590C. The dimension of output hole 590C is set to provide a sufficient amount of mud or mastic to the output hole 590A in the ball or nipple end portion 510A and the corner finishing tool that is attached thereto, so that the mud or mastic may be properly flowed out to, for example, a corner area of a drywall wall or ceiling junction.

Figure 6:
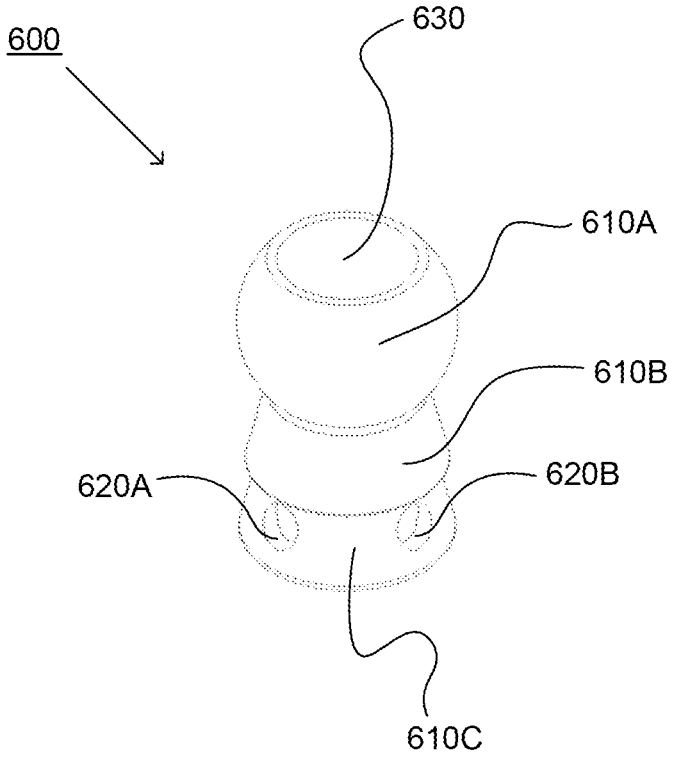
FIG. 6 is an isometric view showing the ball end of the cone, according to an exemplary embodiment of the invention.

Referring now to FIG. 6, an isometric view of an exemplary cone or conically shaped end portion 600 is provided. This portion of the output port assembly may be formed as a cone structure and may have a ball end feature 610A which may be attached to a corner finishing tool via a coupling and retention or latching mechanism so as to form a ball and socket type coupling between the corner applicator box (including the output port assembly) and the corner finishing tool. A central hole or channel 630 may allow the mud or mastic to pass between the corner applicator box. container or housing and the corner finisher tools in order for it to be applied to the corners of, for example, a drywall construction of a room in a building during construction. Directly connected to the ball end feature 610A may be a first angled or flared portion 610B of the cone or conically shaped end portion 600 of the output port assembly. This feature may interact with the corner finisher latching mechanism and thus must withstand the wear which occurs as the finishing tool rotates on the ball and socket configuration, bringing this region 610B of the cone or conically shaped end portion 600 in contact with the latch (see FIG. 4, item 480). At least the area of the first angled portion 610B closest to the ball end feature 610A should be free of overlapping molded material from the container or housing mounting coupling portion to ensure ease of operation of the latching mechanism and freedom of complete rotational movement of the corner finisher tool socket on the ball end feature 610A. The second angled or flared portion 610C may be designed to be internal to the over molded or insert molded container or housing mounting coupling portion and to provide anchoring therein. In addition, through holes 620A and 620B formed in the second angled or flared portion 610C may allow for the over molded or insert molded material to flow through them and form an even stronger interlocking. In addition, the second angled or flared portion 610C may include circular ridges, bumps, texturing, etc., on its outer and/or inner surfaces so as to further promote anchoring of the cone or conically shaped end portion 600 into the over molded or insert molded container or housing mounting coupling portion. For example, in the case of using a plastic or nylon material (filled or non-filled), the second angled or flared portion 610C and through holes 620A and 620B may lock the cone or conically shaped end portion 600 to the plastic or nylon by mechanical interlocking. However, one skilled in the art would recognize that regardless of what material the over molded or insert molded container or housing mounting coupling portion is made from, including a flared shape, through holes, circular ridges, bumps, texturing, etc. may increase the strength of the connection there between so that the output port assembly does not break at this interface during use. Although not illustrated explicitly herein, one would also recognize that if the mounting base 520 is formed as a separate part that it would likewise benefit from the inclusion of a flared shape, through holes, circular ridges, bumps, texturing, etc. in its structure and design to increase the strength of the connection between it and the container or housing mounting coupling portion of the output port assembly.

Figure 7A:
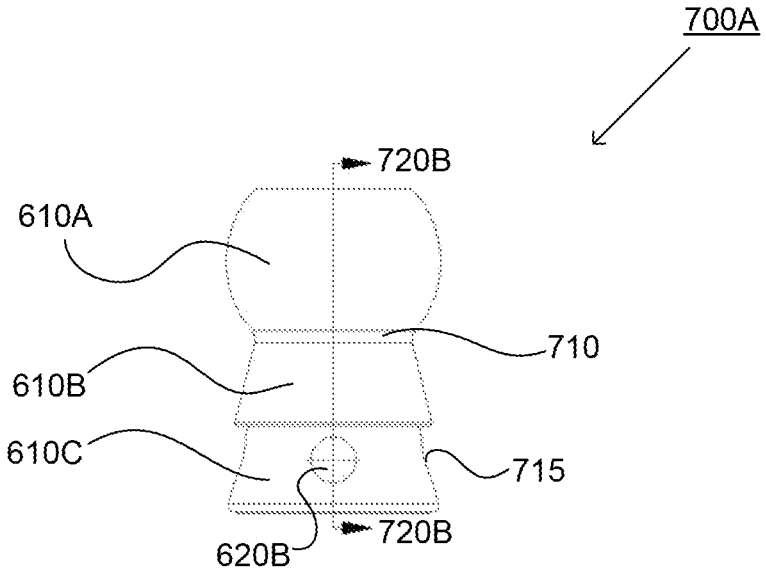
FIGS. 7*a* and 7*b* are a side and section view of the ball end of the cone aspects of the invention, according to an exemplary embodiment of the invention.
Figure 7B:
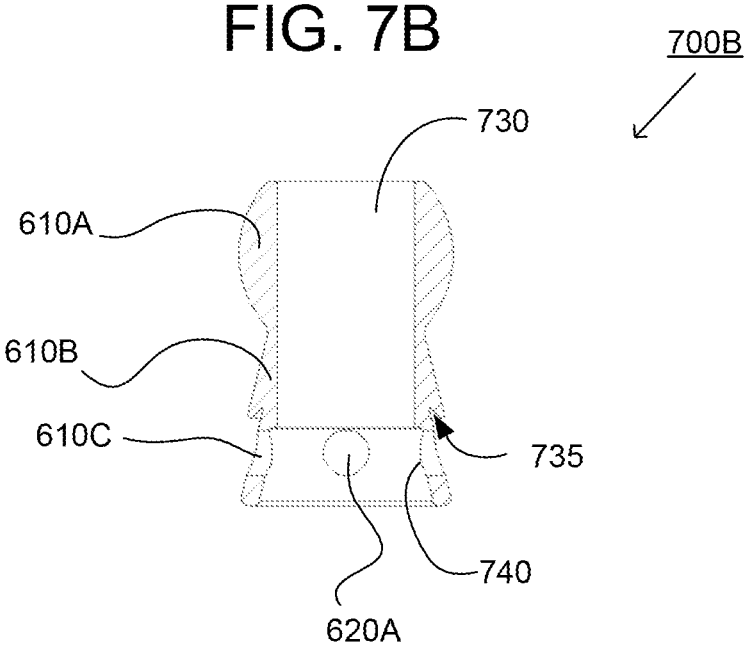

Referring now to FIGS. 7A and 7B, side view 700A and section view 700B of the cone or conically shaped end portion are provided, respectively, according to one embodiment of the invention. In FIG. 7A, it can be more clearly seen that a relatively flat ring area 710 may be formed between the ball end feature 610A and the first angled or flared portion 610B, so as to indicate an interface between the two sections and a location where that should be free of any over molded or insert molded material from the container or housing mounting coupling portion. Further, it is more clearly shown that the outer walls of the second angled or flared portion 610C need not be a flat angle, but may be slightly concave (e.g., indented area 715) so as to provide more surface area and a ridge to better grip the container or housing mounting coupling portion that may be over molded or insert molded onto this portion.

FIG. 7A illustrates a cross section view 700B of the cone or conically shaped end portion taken along line 720B-720B of FIG. 7B. In this view, the output hole or channel 730 is shown to include straight inner walls. However, these walls may be curved to change the flow characteristics of the mud or mastic as it enters the corner finishing tool. Further, the first angled portion 610B may include a hooked or indent shaped area 735, so as to minimize or control the amount of flashing that may occur on this area as a result of over molding the container or housing mounting coupling portion on the second angled portion 610C. In addition, the second angled portion 610C may include a curved inner wall portion 740, within the mud or mastic output hole or channel are that may operate to increase the grip or anchoring (reduce pull out) of the cone or conically shaped end portion in the container or housing mounting coupling portion (see also FIGS. 5A to 5C). As previously noted above, the second angled portion 610C may include one or more means for increasing this gripping or anchoring of the cone or conically shaped end portion. As shown in FIGS. 7A and 7B, the cone or conically shaped end portion may include one or more through holes (e.g., show here with four through holes) that may help to ensure mechanical strength of the coupling between the cone or conically shaped end portion and the container or housing mounting coupling portion.

Figure 8:
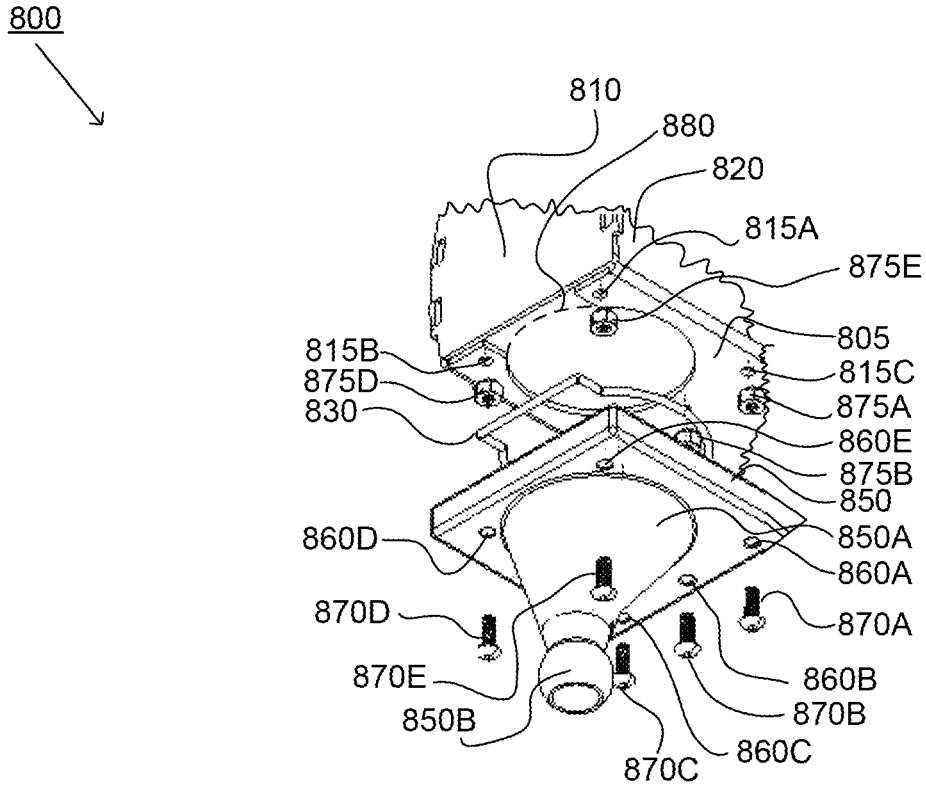
FIG. 8 is an isometric view of the underside of the corner applicator box showing the new assembly aspects of the invention, according to an exemplary embodiment of the invention.

Referring to FIG. 8, an isometric view 800 of a portion of the underside bottom wall 805, front wall 810, and sidewall 820 of the corner applicator box, a sealing member 830, and an output port assembly 850 showing various features and assembly aspects of the invention is provided. The corner applicator box housing structure may be connected to the output port assembly structure 850 with, for example, screws 870A-870E and nuts 875A-875E (875C not shown). As will be described in more detail below, attachment holes 860A-860E may be formed in only the inside or top surface lateral surface of the output port assembly 850, so as to improve cost and time to manufacture and assemble the devices and full assembly 800. The attachment means may be any of a number of different attachment means including screws, bolts, rivets, snap in clips, etc. However, in various embodiments the attachment means may be preferably ones that may be easily installed and removed so that the output port assembly structure 850 and/or the sealing member 830 may be removed for maintenance and/or replacement. The sealing member 830 may be a custom formed seal that may be sandwiched between, for example the output port assembly 850 and portions of the bottom wall 805 and the bottom edge of the front wall 810 of the corner applicator box during assembly so as to create a seal between the bottom wall 805 and front wall 810 of the corner applicator box and the lateral base portion of the output port assembly structure 850. In various embodiments, the sealing member may be formed in a generally circular shape, but have a flat portion extending there from so as to have generally a keyhole shape when looked at in a planar view. This shape will allow proper sealing of the output port assembly structure 850 to bottom wall 805 and the front wall 810 of the applicator box by the sealing member 830, without the need for any additional sealant (although additional sealant may be used). In various embodiments the bottom wall 805 of the applicator box may be extended to cover a portion (e.g., dotted line 880) that abuts the bottom edge of front wall 810 so as to enable the use of a fully or approximately fully circular sealing member (not shown) and resulting in a circular opening in the bottom wall 805 of the applicator box. In any case, the output port assembly 850 container or housing mounting coupling portion 850A and cone or conically shaped section 850B including a ball or nipple, may be constructed generally as described above with respect to FIGS. 5A-7B. It is also noteworthy that the screws 870A-870E and nuts 875A-875E are attached only through the bottom wall 805 of the applicator box so that a seal placed over the edges of the applicator box pressure plate does not touch or interact with them and the seal is not worn by them as a result of moving the pressure plate to its fullest forward position (pushing most of the mud or mastic out of the applicator box and output port assembly 800 (see also FIGS. 4 and 10).

Figure 9:
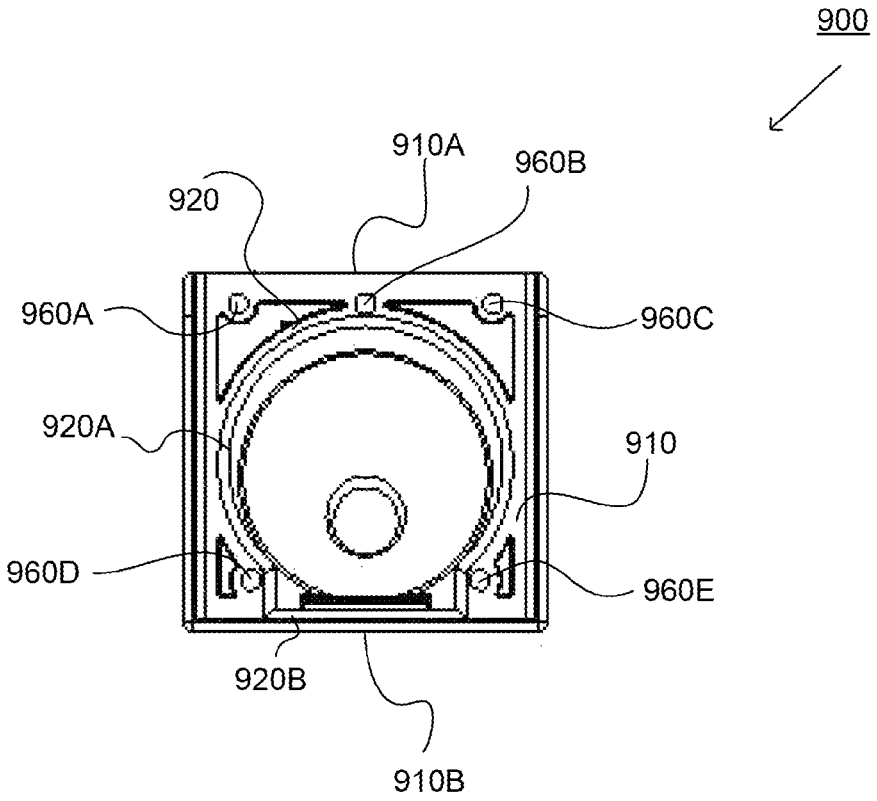
FIG. 9 is a view of the top side of the cone showing the seal groove which locates the seal during and after assembly of the tool, according to an exemplary embodiment of the invention.

Referring now to FIG. 9, a bottom view of the output port assembly structure 900 is shown (looking down into the funnel portion), according to one exemplary embodiment of the invention. The inside or top surface 910 of the output port assembly structure 900 may include a plurality of mounting holes 960A-960E. These are the only mounting holes provided in this particular embodiment for mounting the output port assembly structure 900 to the corner applicator box. As such, manufacturing time and cost of making the output port assembly structure 900 and assembling the output port assembly structure 900 to the corner applicator box may be reduced by placing all the mounting holes on a single side of the output port assembly structure 900. In that way all attachment means, e.g., screws (and nuts), may be installed and parts manufactured (output port assembly structure 900 and corner applicator box) from a single direction or orientation of the output port assembly structure 900 and/or corner applicator during both manufacturing and assembly. Prior to assembly, the sealing means or seal may be placed into and sit in a groove 920 molded into the upper structure of the output port assembly inside or top surface 910. As suggested above, in various embodiments, the sealing member grove 920 (like the sealing member 830) may include a round or curved portion 920A generally formed toward the back edge 910A and side edges of the output port assembly top surface 910, and a generally straight portion 920B associated with the front edge 910B of the output port assembly 900, that may be a custom formed seal made generally in the shape of a keyhole so as to align with the bottom edge of the front wall (e.g., 810) of the corner applicator box during assembly, so as to create a good seal between the bottom wall (e.g., 805) and front wall (e.g., 810) of the corner applicator box and the lateral base portion of the output port assembly structure (e.g., 850).

Figure 10:
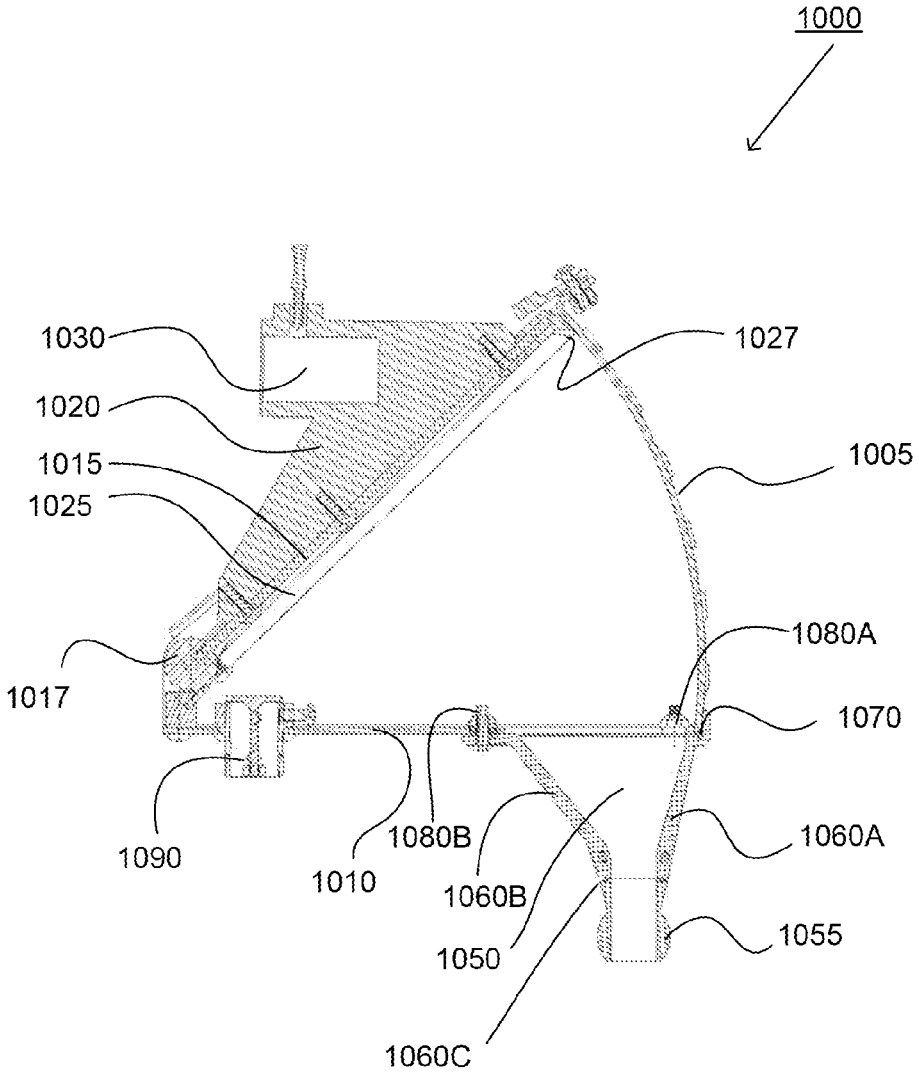
FIG. 10 is a section view of the tool showing the seal assembly aspects of the invention, according to an exemplary embodiment of the invention.

Referring to FIG. 10, a section view 1000 of the applicator box container or housing with an output port assembly attached thereto, according to an embodiment of the present invention, is shown. The top of the container or housing is typically provided by a movable pressure plate 1015 which is used to drive out mud (enclosed in the container or housing) through an output port assembly 1050 (usually through a hole in the bottom wall 1010 opposite the pressure plate) when force is applied to the movable pressure plate 1015 by the user. A handle attachment bracket 1020 is attached to the pressure plate 1015 and includes a hole 1030 for receiving one end of a handle (not shown). The handle may be used to lift the corner applicator box (with output assembly 1050) 1000 and push the pressure plate 1015 so as to apply mastic or mud to, for example, a corner drywall surface. An output port assembly 1050 may be attached to the corner applicator box housing bottom wall 1010. The output port assembly 1050 may include a cone or conically shaped section with a ball or nipple on one end 1055 which may be slightly offset from the center of a container or housing mounting coupling portion so that the ball or nipple end 1055 of the output port assembly 1050 is positioned slightly forward of the center of the output port assembly 1050 and thus formed forward toward the front wall 1005 and the front of the applicator box. It is noteworthy that the angle of the front wall 1060A, the high portion of the back wall 1060B, and the lower portion of the back wall 1060C of the output port assembly (between a flange end and the nipple end) may be comprised of a three different slopes or angled wall pieces as described above, each may have a different angular pitch. In various embodiments, the output port assembly 1050 may be made from a plurality of pieces.

For example, the cone or conically shaped portion including the ball or nipple 1050 may be made of a different material, e.g., zinc, aluminum, or stainless steel and may be formed by using, e.g., casting, molding, drilling, and/or turning. The zinc and aluminum versions may require a coating to protect the part from the corrosive environment experience with working materials such as mastic or mud, as well as to protect from excessive wear in the connecting ball or nipple area 1055, which can be exacerbated by the working materials. The rest of the output port assembly 1050 may be formed from other material, for example a more light weight, more formable, and/or more cost effective material, e.g., using plastic, nylon, etc. materials that may be corrosion resistant and sufficiently durable for their intended purpose, as well as being formable so that they over molded or insert molded or insert molded with the connecting ball or nipple area portion 1055. Further, as noted above, the output port assembly 1050 may be attached to the corner applicator housing bottom wall 1010 using attachment means 1080A and 1080B only from the bottom, for example, screws, bolts, etc., and without any attachment means through the front wall 1055 or side walls. The output port assembly may also include a grove 1070 into which the bottom edge of front wall 1055 may be places so that alignment and sealing are improved. Further, the pressure plate 1015 may be surrounded on three edges by a seal 1025 made of, for example, a malleable rubber or plastic type of material that will withstand wear from the movement of the pressure plate and friction with the inner surface of the housing or container walls. It is noteworthy that the front most edge 1027 of the seal 1025 will run along the inner surface of front wall 1005 when the pressure plate 1015 is moved, but even at full stroke of the pressure plate 1025, when the front edge of the seal 1027 is touching the bottom wall 1010, the seal will never encounter the attachment means 1080A and 1080B and will thus last longer. In any case, when the pressure plate 1015 is moved toward the bottom wall 1010 (pivoting around pivot point 1017), mastic or mud placed in the housing will be forced out through the output port assembly 1050, through the cone or conically shaped portion 1055, and may then be distributed in a corner joint area of a wall via a finishing tool (not shown). Thus, the corner applicator box assembly 1000 according to the present invention may be provided at lower weight and cost, and may typically be used for finishing corners of drywall construction for building walls of rooms inside a building (e.g., office or house).

Referring now back to FIGS. 5A-7B, a description of an exemplary procedure of how to make, produce or manufacture an output port assembly is provided. The conical ball end coupling (e.g., 600) may be manufactured by turning the part on a lathe from tubing or rod stock material. One exemplary manufacturing process would be to cast the conical ball end coupling part (e.g., 600) which may be done by, for example, an investment casting or lost wax process. The investment casting may be, for example, preferred. The conical ball end (e.g., 600) may be then inserted into mold tooling for either plastic injection molding (plastic types of materials) or die casting (metal materials such as AL, Mag, Zinc). Although, the plastic is the preferred approach due to its lower cost and no protective coating required for corrosion or wear.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. For example, the cone and/or the plastic portion may be threaded so they may be screwed together. Thus, the invention is intended to cover alternatives, modifications, and equivalents, which may be included within the spirit and scope of the invention as defined by the claims.

All publications, patent applications, and patents cited herein are hereby incorporated by reference in their entirety for all purposes.

What is claimed is:

1. An apparatus, comprising:

a corner applicator box;

an output port assembly coupled to the corner applicator box and having a first portion made of a first material, a second portion made of a second material that is different from the first material, and a third portion that has a bi-material structure with an over molding interlocking of the first material and the second material.

2. The apparatus of claim 1, further comprising a metal for the first material and a non-metal for the second material.

3. The apparatus of claim 1, further comprising a conical shape for the first portion and not a conical shape for the second portion.

4. The apparatus of claim 3, further comprising having the first portion made of a metal and the second portion made of a plastic, a part of the plastic being molded over at least part of the metal to form the third portion.

5. The apparatus of claim 1, further comprising a preformed geometric seal located between the corner applicator box and the output port assembly.

6. The apparatus of claim 1, further comprising mounting holes located on only one of a plurality of side surfaces of the output port assembly.

7. An apparatus, comprising:

a mastic applicator housing or container;

an output port assembly having a first portion made of a first material, a second portion made of a second material that is different from the first material, and a third portion that has a bi-material structure made of at least a metal portion and a non-metal portion, the output port assembly coupled to the mastic applicator housing or container.

8. The apparatus of claim 7, further comprising having the first portion formed as a cone made of metal and including a ball end to couple another tool to, and the second portion formed as a mounting coupling portion made of a non-metal material, the second portion coupling the first portion of the output port assembly to the mastic applicator housing or container.

9. The apparatus of claim 8, further comprising having the cone include at least one material which is a stainless steel.

10. The apparatus of claim 7, further comprising having the non-metal portion include at least one material which is a plastic.

11. The apparatus of claim 7, further comprising:

a preformed non-symmetrical geometric seal located between the mastic applicator housing or container and the output port assembly.

12. The apparatus of claim 7, further comprising mounting holes located on only one of a plurality of side surfaces of the output port assembly.

13. The apparatus of claim 7, further comprising the output port assembly further including:

a first wall facing a first direction and that has a linear straight set slope or angle, and a second wall at least in part facing a second direction opposite the first direction and having at least one inflection point in at least one portion of its length.

14. A mastic applying tool, comprising;

a corner applicator box;

an output port assembly mounted to the corner applicator box; and a non-symmetrical geometric preformed seal located between the corner applicator box and the output port assembly.

15. A mastic applying tool of claim 14, further comprising having the output port assembly include a cone portion and a mounting coupling portion that are formed as a unitary structure which is a composite of at least two materials formed as separate sections.

16. A mastic applying tool of claim 15, further comprising having the cone portion include at least one material which is a metal.

17. A mastic applying tool of claim 15, further comprising having the mounting coupling portion include at least one material which is a plastic.

18. A mastic applying tool of claim 14, further comprising having the non-symmetrical geometric preformed seal be non-circular.

19. A mastic applying tool of claim 14, further comprising having the output port assembly include a channel formed therein that is the shape of the seal, and the seal is place into and retained by the channel.

20. A mastic applying tool of claim 14, further comprising the output port assembly further including:

a first wall facing a first direction and that has a linear straight set slope or angle, and a second wall at least in part facing a second direction opposite the first direction and having at least one inflection point in at least one portion of its length.

* * * * *